US005226719A

United States Patent [19]

Feldpausch et al.

[11] Patent Number: 5,226,719

[45] Date of Patent: Jul. 13, 1993

[54] QUICK MOUNTING ARRANGEMENT FOR LIGHT FIXTURES IN OVERHEAD CABINETS AND THE LIKE

[75] Inventors: Michael J. Feldpausch; Stephen J. Feldpausch, both of Hastings; Albert O. Selen, Plainwell, all of Mich.

[73] Assignee: Steelcase Inc., Grand Rapids, Mich.

[21] Appl. No.: 896,103

[22] Filed: Jun. 8, 1992

[51] Int. Cl.[5] ..... F21V 33/00

[52] U.S. Cl. ..... 362/133; 362/427; 362/127

[58] Field of Search ..... 362/133, 127, 217, 147, 362/427, 365

[56] References Cited

U.S. PATENT DOCUMENTS

| | | |
|---|---|---|
| 2,791,681 | 5/1957 | Dunker et al. . |
| 3,018,082 | 1/1962 | Berger . |
| 3,381,126 | 4/1968 | Steiner . |
| 3,697,743 | 10/1972 | Eargle . |
| 3,790,774 | 2/1974 | Miller et al. . |
| 3,831,019 | 8/1974 | Halfaker et al. . |
| 4,155,111 | 5/1979 | Kelly et al. . |
| 4,157,584 | 6/1979 | Bhatt . |
| 4,164,009 | 8/1979 | Maguire, Jr. et al. . |
| 4,203,639 | 5/1980 | VandenHoek et al. . |
| 4,222,093 | 9/1980 | Garcia et al. . |
| 4,279,397 | 7/1981 | Larsson . |
| 4,419,717 | 12/1983 | Price et al. . |
| 4,424,554 | 1/1984 | Woloski et al. . |
| 4,432,044 | 2/1984 | Lautzenheiser . |
| 4,454,569 | 6/1984 | Maguire . |
| 4,497,014 | 1/1985 | Woloski et al. . |
| 4,910,650 | 3/1990 | Goralnik . |
| 4,941,071 | 7/1990 | Knauf . |
| 5,092,253 | 3/1992 | Grund et al. . |

*Primary Examiner*—Carroll B. Dority
*Attorney, Agent, or Firm*—Price, Heneveld, Cooper, DeWitt & Litton

[57] ABSTRACT

A quick mounting arrangement detachably mounts a light fixture or the like in an overhead cabinet of a furniture article. Front and rear mounting ledges are located in the lower portion of the cabinet and are oriented to generally face one another. Two fixed latches protrude from the rear of the light fixture and include a clip to hold a power cord and the light, and at least one reciprocating latch protrudes from the front side of the light fixture. Each reciprocating latch is a one-piece molded part including a body adapted to slidingly fit in a shaped aperture in the light fixture, a first leg adapted to abuttingly engage the front mounting ledge, and a second leg extending at an angle from the first leg free end toward the light fixture to form a ramp. During installation, the light fixture is positioned at an angle so that the fixed latch rests on the rear ledge, and the reciprocating latch is positioned ready to be rotated toward the front ledge. As the light fixture is rotated upwardly, the reciprocating latch engages the front ledge, causing the second leg to ramp against the front ledge and bias the first leg to a recessed position. As the light fixture is further rotated to its final position, the second leg passes past the front ledge, and the first leg springs to a latch position abuttingly resting on the front ledge. Notably, the reciprocating latch can be released by manually biasing the first leg to the release position and dropping the light fixture downwardly. The latching and installation is accomplished without the use of separate fasteners or tools.

18 Claims, 4 Drawing Sheets

QUICK MOUNTING ARRANGEMENT FOR LIGHT FIXTURES IN OVERHEAD CABINETS AND THE LIKE

BACKGROUND OF THE INVENTION

The present invention relates to furnishings for offices and similar settings, and in particular to a mounting arrangement for light fixtures in overhead cabinets, cases or the like.

Open office plans are well known in the art, and generally comprise large, open floor spaces that are partitioned off into individual workstations. One arrangement for partitioning off the open floor space is to provide movable partition panels that are configured to receive hang-on furniture units, such as worksurfaces, overhead cabinets, shelves, etc. Such partitioning arrangements are usually known in the office furniture industry as "systems furniture".

A unique alternative for arrangement for dividing and partitioning open office plans is disclosed in U.S. Pat. No. 5,092,253, the arrangement providing a plurality of individual furniture units, each of which is independently supported on the floor of the open office. Such freestanding furniture units have a novel modular construction which permits them to be individually arranged and combined in predetermined configurations to create distinct workstations.

In both systems furniture and modular furniture arrangements, light fixtures may be mounted underneath overhead cabinets, upper cases, or similar storage units to provide task lighting for the worksurface disposed therebelow. Historically, such light fixtures were attached directly to the bottom of the overhead cabinet by conventional fasteners, such as threaded screws or the like. Exemplary task lighting arrangements are disclosed in U.S. Pat. Nos. 4,203,639 and 4,432,044. In such mounting arrangements, the position of the light fixture in the cabinet is fixed, and cannot be readily adjusted once it is fastened in place. Furthermore, the relative size and weight of the light fixture, as well as the rather difficult location and orientation of attachment, renders installation of the light fixture both awkward and time consuming, and often requires more than one skilled installer.

An improved quick mounting arrangement for light fixtures in overhead cabinets is disclosed in U.S. Pat. No. 4,941,071. This arrangement provides a quick installation without the need for separate fasteners. In particular, the arrangement provides two mounting pins 7 that protrude from a rear side of the light fixture and at least one latch 8 with a spring loaded slide pin 9 that extends from the front side of the light fixture. The slide pin 9 is held in a retracted condition during installation, and then released to secure the light fixture in place. Further, a thumb tab 10 is located on the slide pin 9 to facilitate depressing the slide pin during installation, and is rotatable to a hidden storage position for safety and aesthetics.

However, further improvement is desired. The latches 8 noted above are somewhat expensive since they are assembled from multiple parts and pieces. Further, it is necessary to hold slide pin 9 in the retracted or depressed condition as the light fixture is rotated upwardly into the installed position, thus occupying the installer's hands and preventing the installer from holding the light fixture in a more secure and less cumbersome way. Still further, the thumb tab on the latch 8 is not fully hidden, thus reducing aesthetics somewhat, particularly if the thumb tab is not rotated upwardly to the semi-hidden storage position.

SUMMARY OF THE INVENTION

One aspect of the present invention is a detachable mounting arrangement to quickly and securely mount light fixtures and the like in overhead cabinets without requiring any tools, and without requiring the installer to continuously hold latches in a particular position during installation. Mounting ledges are located in the lower portion of the cabinet, and are oriented to face one another. Fixed latches protrude from one side of light fixture, and at least one reciprocating latch protrudes from an opposite side of the light fixture. Each reciprocating latch includes a first leg with a portion shaped for abutting support on the front support ledge when the reciprocating latch is in the fully extended position, and a second leg with a portion which is ramp-shaped and oriented at a generally acute angle to the first leg portion to slidingly abut a rearward edge of the front support ledge during installation. The reciprocating latch is resiliently biased toward a fully extended position. During installation of the light fixture, the fixed latches are positioned on one of the ledges, and the free side of the light fixture is pivoted upwardly into the bottom of the cabinet. During this pivoting movement, the ramp-shaped portion of the reciprocating latch second leg slidingly abuts the rearward edge of the front support ledge, and thereby shifts the reciprocating latch toward the fully retracted position until the first leg portion passes over the rearward edge of the support ledge. At such time, the biasing mechanism resiliently shifts the reciprocating latch to the fully extended position to engage the first leg portion with the front support ledge, and thereby securely mounting the light fixture in the raised position without requiring any tools.

In the preferred form, the reciprocating latch and the fixed latch are both one-piece molded articles and are adapted to snap-fit onto the light fixture. Also, the fixed latch includes an integral clip for retaining the power cord of the light fixture, so as to hold the cord in a desirable and hidden location. Also, the reciprocating latch includes integral and resilient legs arranged to support the weight of the light fixture and also arranged to bias the reciprocating latch to an extended position on the light fixture.

Principle objects of the present invention are to provide a quick mounting arrangement which is low cost and which is capable of quickly and securely mounting light fixtures and the like in overhead cabinets, without requiring any tools, and also without requiring continuous holding of the latches during installation. The self-locking reciprocating latch enables a single installer to easily mount and/or remove the light fixture in a convenient and strain-free manner. Additionally, the hands of the assembler are free during the installation since the reciprocating latches are self-actuating and do not need to be held in an open condition. The mounting arrangement of the preferred embodiment has a readily manufacturable design with reduced manufacture costs, is efficient in use, is capable of long operating life, and is particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
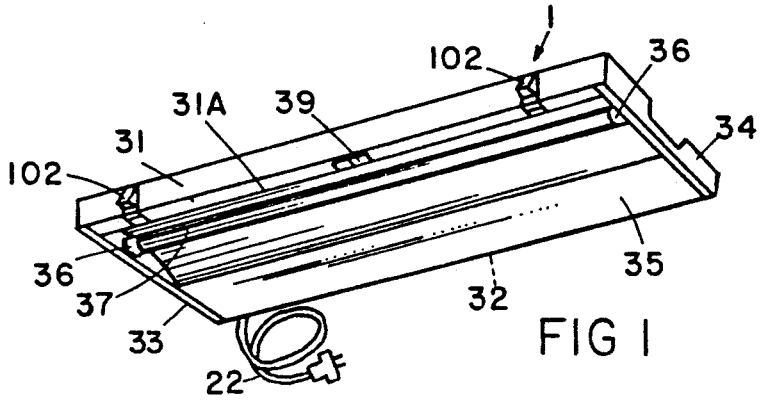
FIG. 1 is a front perspective view of a light fixture incorporating a mounting arrangement embodying the present invention.

For the purposes of description herein, the terms "upper," "lower," "right," "left," "rear," "front," "vertical," "horizontal," and derivatives thereof shall relate to the invention as oriented in FIG. 1, as viewed by a seated user. However, it is to be understood that the invention may assume various alternative orientations, except where expressly specified to the contrary. It is also to be understood that specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
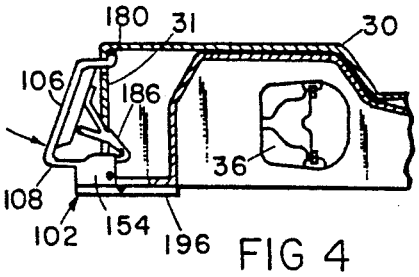
FIG. 4 is a fragmentary vertical cross-sectional view of the light fixture, showing a reciprocating latch portion thereof in a normally fully extended position.
Figure 5:
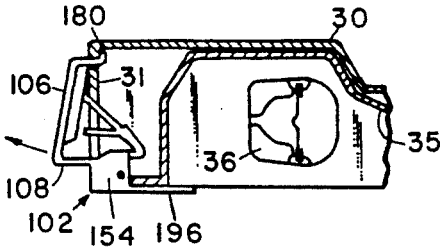
FIG. 5 is a fragmentary vertical cross-sectional view of the light fixture showing the reciprocating latch in a fully retracted position.

Reference numeral 1 (FIGS. 1–4) generally designates a detachable quick mounting arrangement embodying the present invention. Quick mounting arrangement 1 is particularly adapted to removably mount to a light fixture 2 in an overhead storage unit, such as the illustrated case or cabinet 3 of modular furniture 4. Front and rear mounting ledges 5 and 6 (FIGS. 6 and 7) are located in the lower portion of cabinet 3, and are oriented to face one another. Two fixed mounting latches 100 protrude from the rear side of light fixture 2, and at least one reciprocating latch 102 protrudes from the front side of light fixture 2. Each reciprocating latch 102 is a one-piece part constructed to slidingly mount to light fixture 2 so that latch 102 can be manually shifted from a normally fully extended position (FIG. 4) to a fully retracted position (FIG. 5). Both latches 100 and 102 can be snap-fitted into light fixture 2 without the need for separate fasteners or tools.

During installation of light fixture 2, fixed latches 100 are positioned on rear ledge 6, and the front side of light fixture is pivoted upwardly into the bottom of cabinet 3. As light fixture 2 is pivoted upwardly, a ramp-shaped leg 106 on reciprocating latch 102 rampingly slidingly engages front ledge 5 to bias latch 102 to a fully retracted position. Once ramp-shaped leg 106 passes beyond front ledge 5, reciprocating latch 102 is shifted back to the extended position where a second leg 108 on reciprocating latch 102 abuttingly engages front ledge 5 to retain light fixture 2 in cabinet 3. Notably, legs 106 and 108 are resiliently interconnected so that they press against the light fixture side wall to bias reciprocating latch 102 toward the normally extended position.

Figure 3:
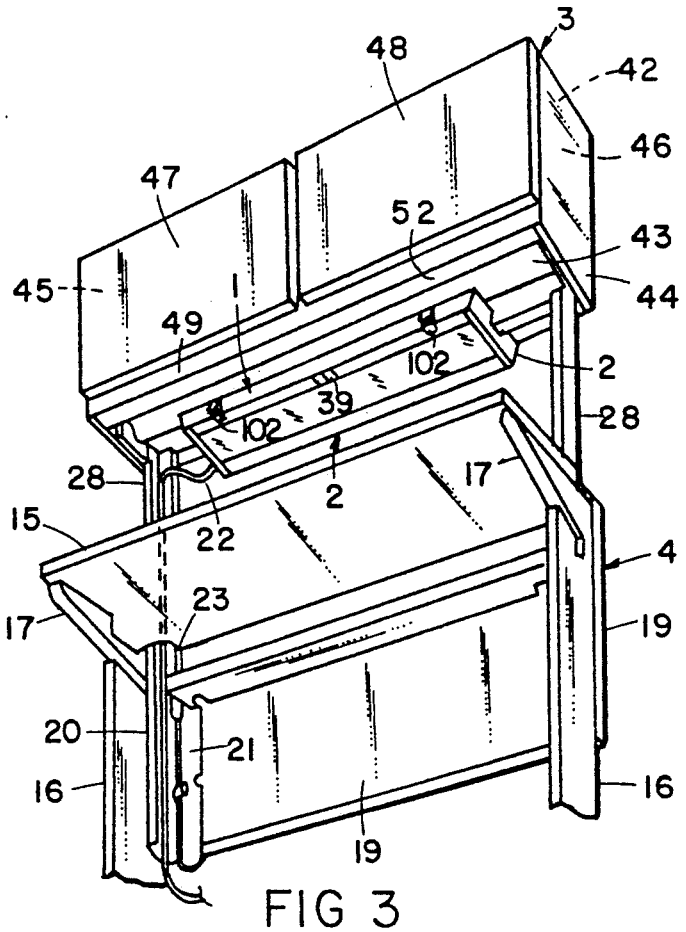
FIG. 3 is a perspective view of the light fixture, the light fixture being shown exploded a distance downwardly from the installed position in an overhead cabinet.

With reference to FIG. 3, mounting arrangement 1 is particularly adapted for use in conjunction with a modular furniture arrangement such as is disclosed in U.S. Pat. No. 5,092,253. The furniture arrangement comprises a plurality of individual furniture units 4, each of which is independently supported on the floor of an office space, and is shaped to cooperate with other, related furniture units to form workstations. The illustrated modular furniture unit 4 is a straight worksurface unit, comprising a worksurface panel 15, which is supported at opposite ends by a pair of intermediate supports 16. Intermediate support 16 have an inverted generally L-shaped side elevational configuration, with upper arm 17 thereof attached to the lower surface of worksurface panel 15, such that intermediate supports 16 support worksurface panel 15 in a cantilevered fashion. The space disposed underneath worksurface panel 15 adjacent to intermediate supports 16 is generally open and unobstructed to facilitate unfettered task chair movement along the forward edge of worksurface panel 15.

A back panel 19 (FIG. 3) is attached to the rearward edges of intermediate supports 16, extends along the rearward edge of worksurface panel 15, and generally covers the rearward face or side of modular furniture unit 4. L-shaped brackets 20 with mating removable covers 21 are attached to the interior sides of intermediate supports 16 and back panel 19, and form a covered wireway through which wiring, cabling, and the like, such as the illustrated power cord 22 may be routed. The rear corners 23 of worksurface panel 15 include arcuate cutouts which mate with the brackets 20 to route power cord 22 through worksurface panel 15, and upwardly to overhead light fixture 2.

Overhead cabinet 3 (FIG. 3) is mounted on modular furniture unit 4 above worksurface panel 15 by a pair of transaction posts 28. Transaction posts 28 have their lower ends attached to intermediate supports 16 and back panel 19, and extend vertically upwardly through the cutout rear corners 23 of worksurface panel 15 in a mutually parallel relationship. The upper ends of transaction posts 28 are attached to rearward portions of overhead cabinet 3, so as to support the cabinet in a cantilevered fashion above worksurface panel 15. The illustrated transaction posts 28 have a generally L-shaped plan configuration, and are vertically aligned with brackets 20 to form a continuous wireway through which power cord 22 may be routed from overhead cabinet to the bottom modular furniture unit 4. Removable covers (not shown) are preferably provided for transaction posts 28 to enclose the same.

The illustrated light fixture 2 (FIGS. 1 and 2) has a generally conventional construction other than mounting arrangement 1, and includes a chassis 30 with marginal edges or walls 31-34 and a formed light reflector panel 35. In illustrated example, light fixture 2 has a form sheet metal construction with a recess defined in the lower portion thereof in which a pair of opposing electrical connectors or lamp holders 36 mount a fluorescent light tube 37. Light fixture 2 includes a conventional ballast 37A (FIGS. 6 and 7), which is connected with fluorescent tube 37, and flexible power cord 22 (FIGS. 1 and 2) to electrically connect light fixture 2 with a source of electrical power. A toggle switch 39 is mounted on the lower edge of front face 31A, and is connected with light fixture 2 to switch fluorescent lighting tube 37 on and off.

The illustrated overhead cabinet (FIG. 3) has a generally rectangular shape, and includes a top panel 42, a bottom panel 43, opposite end panels 44 and 45 and a rear panel 46, which are fixedly interconnected to form a recess for receiving chassis 30 of light fixture 2. A channel 49 extends along the front side of overhead cabinet 3, between end channels 44 and 45, along the lower portion thereof. Front channel 49 and panels 42–45 frame an opening at the forward side of cabinet 3, which is selectively closed by a pair of pivotally mounted closures or doors 47 and 48.

Figure 6:
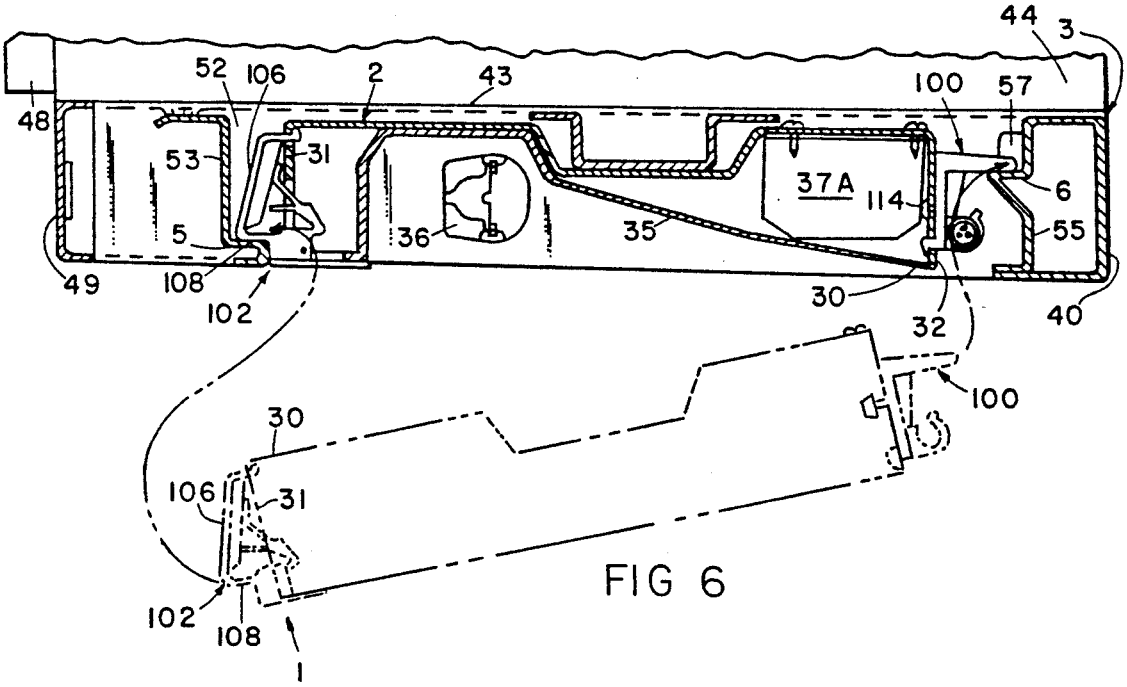
FIG. 6 is a fragmentary vertical cross-sectional view of the overhead cabinet and light fixture, particularly illustrating installation of same.

With reference to FIG. 6, the bottom panel 43 of overhead cabinet 3 is positioned upwardly from the lowermost edges of front channel 49 and panels 44–46, so as to form a socket or recess 52 in the lower portion of overhead cabinet 3. A Z-shaped channel 53 is mounted adjacent front channel 49 and extends along the forward edge of overhead cabinet 3. Front channel 53 forms a generally horizontally disposed front track or ledge 5, which is in the nature of a rail, and extends generally along the length of overhead cabinet 3, and faces generally rearwardly. In the embodiment shown, channel 53 has a "Z" shape and extends upwardly where it attaches to panel 43, however it is contemplated that in some applications channel 53 need not extend upwardly into contact with panel 43. Second channel 55 extends substantially continuously along the rearward lower portion of overhead cabinet 3, adjacent rear panel 46. Rear channel 55 includes a rear track or ledge 6, which is also in the nature of a rail, and faces generally forwardly, opposite front mounting ledge 5. In the illustrated example, front mounting ledge 5 is positioned adjacent a lower portion of recess 52, whereas rear mounting ledge 6 is positioned adjacent the rearwardmost lower portion of recess 52.

The length of lighting fixture 2 is preferably substantially less than the associated length of recess 52, so as to permit the longitudinal position of light fixture 2 in overhead cabinet 3 to be slidingly adjusted. The illustrated rear channel 55 includes a plurality of forwardly or upwardly protruding tabs or stops 57 which are positioned to abut fixed latches 100, and thereby positively limit the longitudinal or side-to-side movement of light fixture 2 in cabinet 3. Stops 57 may be spaced apart at regular intervals adjacent the ends of rear mounting ledge 6, so as to provide a plurality of positive stop positions. When stops 57 are provided, substantial longitudinal adjustment of light fixture 2 and cabinet 3 may require removal and replacement of light fixture 2 in cabinet 3.

Figure 2:
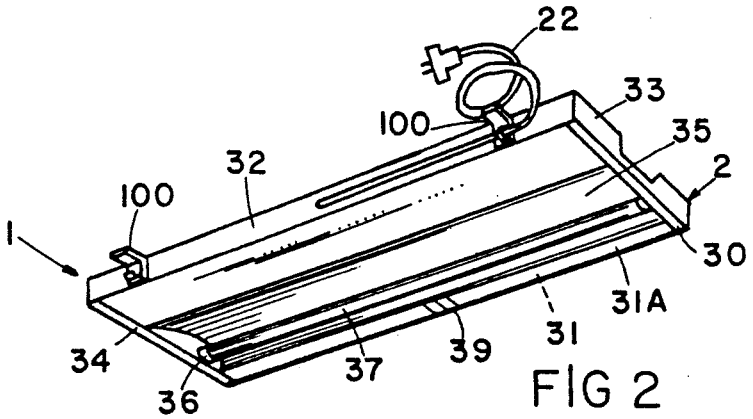
FIG. 2 is rear perspective view of the light fixture.
Figure 8:
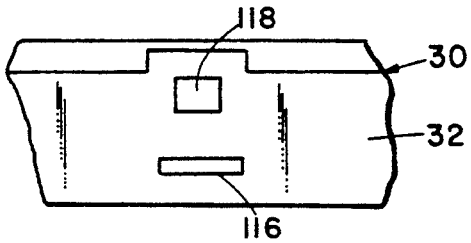
FIG. 8 is an elevation view of the mounting holes for the fixed latch.
Figure 9:
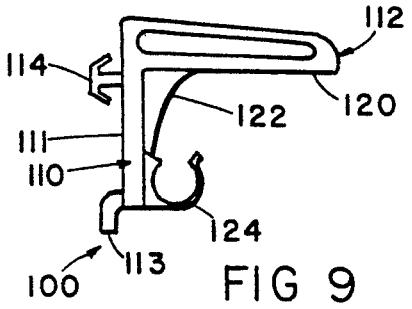
FIG. 9 is a side elevational view of the fixed latch.

With reference to FIGS. 1 and 2, the illustrated light fixture 2 includes two fixed latches 100 extending rearwardly from the rear wall 32 thereof adjacent but spaced inwardly from opposite ends of light fixture 2. Fixed latches 100 (FIG. 9) are stationary, and have a substantially identical construction. Fixed latches 100 (FIG. 9) are generally L-shaped and include first and second perpendicular arms 110 and 112. Arm 110 includes a flat outer surface 111 having a width sufficient to stably engage marginal edge 32 of light fixture 2. Arm 110 includes a tongue 113 at its free end and a snap-fitting protrusion 114 spaced from tongue 113, tongue 113 and protrusion 114 being adapted to securely engage spaced holes 116 and 118 respectively on wall 32 (FIG. 8) of light fixture 2. A C-shaped clip 124 is integrally molded on first arm 110 on the opposite side of arm 110 from tongue 113. Clip 124 is adapted to receive and hold power cord 22 in the concave shape of clip 124 so that power cord 22 is held in a desired position after installation of light fixture 2.

Second arm 112 extends perpendicularly to first arm 110 and away from tongue 113 and protrusion 114. Second arm 112 has an I-beam-like cross-sectional shape which includes a flat surface 120 on its inner side which is adapted to engage rear ledge 6. Second arm 112 is reinforced by a rib 122 connecting arms 110 and 112 on the concave side thereof so that fixed latch 110 can stably carry and support the weight of light fixture 2.

Figure 10:
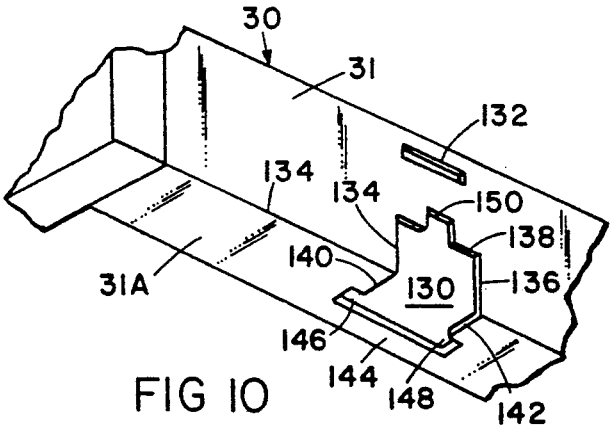
FIG. 10 is a perspective view of the mounting holes for the reciprocating latch.
Figure 11:
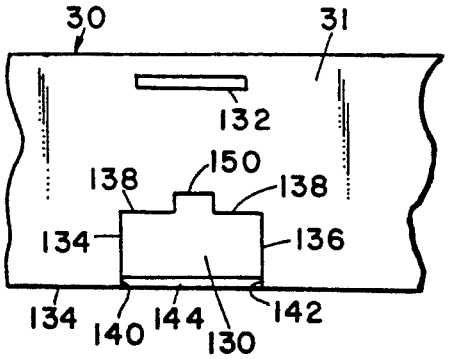
FIG. 11 is an elevational view of the mounting holes for the reciprocating latch.
Figure 12:
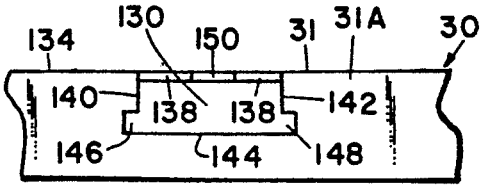
FIG. 12 is a bottom plan view of the lower mounting hole for the reciprocating latch.

With reference to FIGS. 10–12, wall 31 of light fixture 2 includes two pair of apertures 130 and 132 for receiving reciprocating latches 102, one pair of apertures 130 and 132 being located near each end of wall 31. In particular, aperture 130 is located at a lower corner 134 of wall 31 and extends from wall 31 onto a perpendicular lower front wall section 31A of light fixture 2. Aperture 130 includes a generally rectangular body-receiving portion defined by a pair of opposing upper marginal side edges 134 and 136, a top marginal side edge 138, a pair of lower marginal side edges 140 and 142 that align with upper side edges 134 and 136, and a rear marginal side edge 144. Opposing cutouts 146 and 148 are notched into side edges 140 and 142 near rear marginal side edge 144. Further, a second cutout 150 is notched into top marginal side edge 138.

Figure 13:
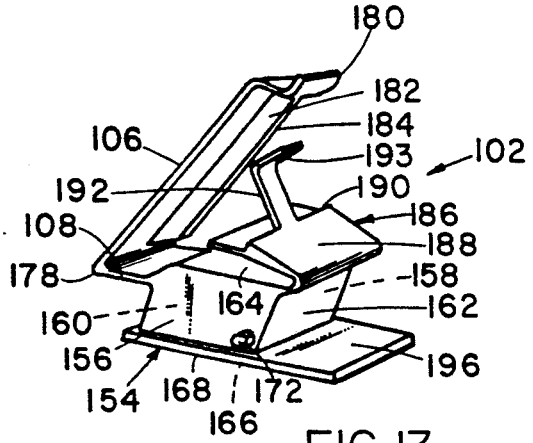
FIG. 13 is a perspective view of the reciprocating latch.
Figure 14:
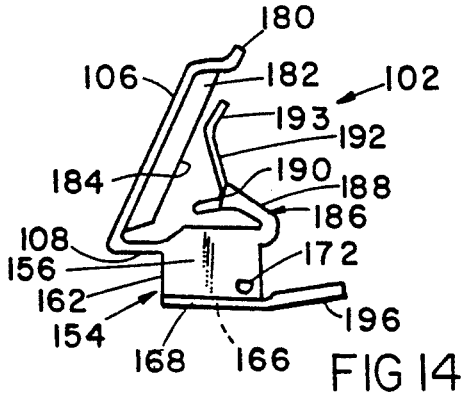
FIG. 14 is a side elevation view of the reciprocating latch.
Figure 15:
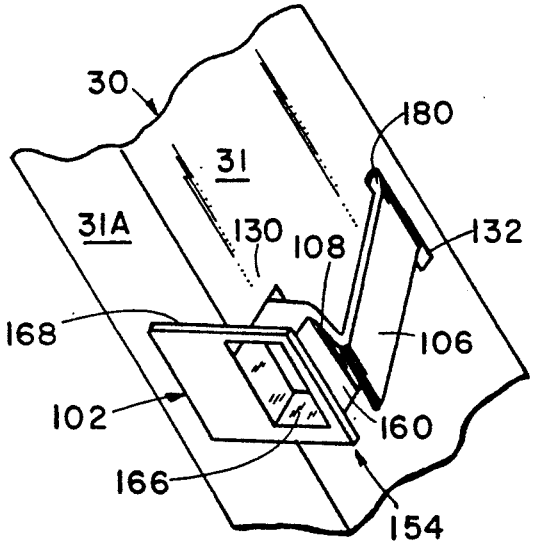
FIG. 15 is a bottom perspective view of the reciprocating latch installed on the light fixture, the reciprocating latch being in the fully extended position.

In the illustrated example, light fixture 2 (FIGS. 13–17) includes two reciprocating latches 102, which are adapted to be operably inserted into apertures 130 and 132 so that portions of the latches 102 extend forwardly from the front wall 31 near the opposite ends of light fixture 2. Each reciprocating latch 102 has a substantially identical construction and is a one-piece part molded of a resilient engineering polymer or the like (FIGS. 13–15). Reciprocating latch 102 includes a rectangular hollow body 154 having side walls 156 and 158, front and rear walls 160 and 162 and a top wall 164, which walls define an open recess 166. Recess 166 is useful as a grip for receiving an operator's fingertip to manually move and release reciprocating latch 102, as described below. Body walls 156, 158 and 164 define a width adapted to slideably fit within marginal edges 134, 136, 138, 140, 142 and 144 of aperture 130 (FIG. 10). Two opposing flanges 168 extend outwardly from body sidewalls 156 and 158 near a lower edge thereof. Two opposing protrusions 172 also extend outwardly from side walls 156 and 158, with flanges 168 and protrusions 172 forming a pair of grooves therebetween for slideably receiving lower marginal side edges 140 and 142. Protrusions 172 are sized to slip through opposing cutouts 146 and 148 as reciprocating latch 102 is installed into aperture 130. The body rear wall 162 abuttingly engages rear marginal side edge 144 of aperture 130 (FIG. 17) to limit the rearward movement of reciprocating latch 102 as latch 102 is moved to the fully retracted position.

Leg 108 (FIGS. 13–15) extends forwardly of body front wall 160 at a location slightly below top wall 164, but generally parallel thereto. Leg 108 includes a free end 178 to which leg 106 is attached, with leg 106 extending generally upwardly and slightly rearwardly at an acute angle to leg 108. The free end of leg 106 includes a tongue 180 shaped to engage aperture 132 in light fixture 2 with a hook-like action as latch 102 is installed. A reinforcement rib 182 extends longitudinally along leg 106 to stiffen same, rib 182 having a depth of about ⅛ inch and defining a rearward surface 184. Notably, legs 106 and 108 are resilient and form a leaf-spring-like L-shaped arrangement that urges body 154 (and reciprocating latch 102) toward an extended position so that leg 106 engages front ledge 5 to securely hold light fixture 2 in place in the recess in overhead cabinet 3.

A stop 186 extends angularly upwardly from body rear wall 162 above top wall 164 and then extends in a direction forwardly of rear wall 162. Stop 186 includes a ramp-like section 188 that slidingly engages top marginal side edge 138 of aperture 130 during the installation of reciprocating latch 102 into aperture 130, and further includes a terminal end 190 that snaps upwardly into a retaining position against the back side of marginal side edge 138 as reciprocating latch body 154 is finally installed into aperture 130. A centering tab 192 extends at an angle upwardly and outwardly from terminal end 190, centering tab 192 fitting through cutout 150 in top marginal side edge 138. Tab 192 includes a free end 193 that engages rib rear surface 184 on leg 106. This serves to prevent internal wires from lodging between surface 190 and the back side of surface 138 during the actuation of reciprocating latch 102.

Figure 16:
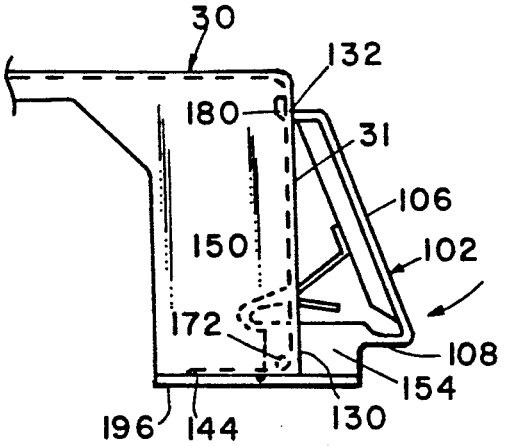
FIG. 16 is a side elevational view of the reciprocating latch as installed in the light fixture, the reciprocating latch being in the fully extended position.
Figure 17:
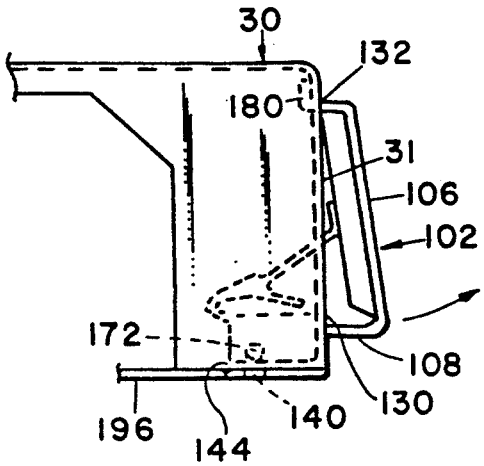
FIG. 17 is a side elevational view of the reciprocating latch as installed in the light fixture, the reciprocating latch being in the fully retracted position.

A planar flange 196 extends rearwardly from the bottom of body rear wall 162. Flange 196 covers the rearwardly extending portion of aperture 130 in light fixture marginal edge 31A when reciprocating latch 10 is in the extended position (FIG. 16). Preferably, flange 196 is molded to extend at a slight angle upwardly when in the free state (FIG. 14) so that, when installed, flange 196 always presses tightly against wall 31A during manipulation of reciprocating latch 102.

Figure 7:
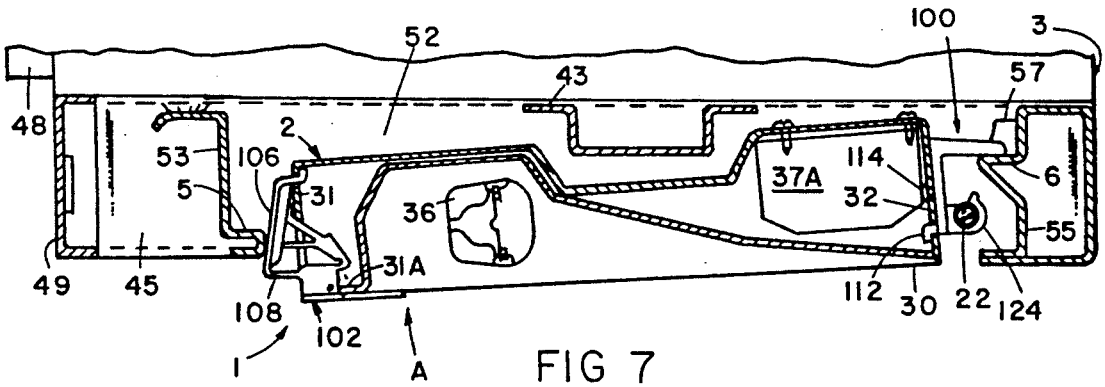
FIG. 7 is a fragmentary vertical cross-sectional view of the overhead cabinet and light fixture, with the light fixture partially installed therein.

In operation, light fixture 2 is installed in overhead cabinet 3 in the following manner. Fixed latches 100 protruding from the rear wall 32 of light fixture 2 are first positioned on rear mounting ledge 6 (FIG. 7). The installer then grasps light fixture 2 in a secure and stable manner, and begins to rotate fixture 2 upwardly into position as illustrated by arrow "A". As light fixture 2 is rotated or pivoted upwardly into the bottom recess 52 of overhead cabinet 3, ramp-like leg 106 slidingly engages the rear edge of front mounting ledge 5 in the recess of cabinet 3. This causes reciprocating latch 102 to move toward a fully retracted position within light fixture 2 and partially behind wall 31. As light fixture 2 is further rotated into position (FIG. 6), legs 106 and 108 pass over the rearward edge of front mounting ledge 5, at which time the resilient nature of legs 106 and 108 resiliently bias reciprocating latch 102 to the fully extended position to engage leg 108 with front mounting ledge 5. Thus, light fixture 2 is securely mounted to cabinet 3 in the raised position, without requiring any tools and without requiring an operator to hold reciprocating latch 102 in a retracted position.

To remove light fixture 2 from overhead cabinet 3, the installer first places his fingertips within recess 166 (FIG. 15) of reciprocating latch 102, and manually biases reciprocating latch 102 into the retracted position. The above steps are then repeated in reverse order.

Mounting arrangement 1 is capable of quickly and securely mounting light fixture 2 in overhead cabinet 3 without any tools whatsoever, and without the operator having to hold reciprocating latches in a retracted position. In particular, the reciprocating latches 102 permit a single installer to removably install light fixture 2 without unnecessary strain.

In the foregoing description, it will be readily appreciated by those skilled in the art that modifications may be made to the invention without departing from the concepts disclosed herein. Such modifications are to be considered as included in the following claims, unless these claims, by their language expressly state otherwise.

The embodiments of the invention in which an exclusive property or privilege is claimed are defined as follows.

1. In a light fixture for raised furniture units and the like, the improvement of a detachable mounting arrangement therefor, comprising:

a front support ledge adapted for positioning in a lower portion of a raised furniture unit, and facing generally rearwardly;

a rear support ledge adapted for positioning in the lower portion of the raised furniture unit, and facing generally forwardly, opposite said front support ledge;

a fixed latch connected with said light fixture, and protruding outwardly from a rear portion thereof; said fixed latch being shaped for abutting support on said rear support ledge;

a reciprocating latch connected with said light fixture, and selectively protruding outwardly from a front portion thereof for shifting between a fully extended position, and a fully retracted position; said reciprocating latch having a first leg with a portion thereof shaped for abutting support on said front support ledge when said reciprocating latch is in the fully extended position, a second leg with a portion thereof ramp-shaped and oriented at a generally acute angle to said first leg portion to slidingly abut a rearward edge of said front support ledge, and means for resiliently biasing said reciprocating latch toward the fully extended position, whereby said light fixture is mounted in the raised furniture unit by positioning said fixed latch on said rear support ledge, pivoting the front portion of said light fixture upwardly into the lower portion of the raised furniture unit, such that the ramp-shaped portion of said latch second leg slidingly abuts the rearward edge of said front support ledge, and thereby shifts said reciprocating latch toward the fully retracted position until said first leg portion passes over the rearward edge of said front support ledge, at which time said biasing means resiliently shifts said reciprocating latch to the fully extended position to engage said first leg portion with said front support ledge, and thereby securely mount said light fixture in the raised furniture unit, without requiring any tools.

2. A light fixture, as set forth in claim 1, wherein: said reciprocating latch has a one-piece, resilient construction configured to define at least a portion of said biasing means.

3. A light fixture as set forth in claim 2, including: a flexible cord for supplying electrical power to said light fixture; and wherein said fixed latch includes a clip for detachably retaining said cord therein to position the same neatly within said light fixture.

4. A light fixture as set forth in claim 3 wherein said front portion of said light fixture includes material defining a first opening, and said reciprocating latch is adapted to slideably engage said material and move between said extended position and said retracted position.

5. A light fixture as set forth in claim 4 wherein said fixed latch and said reciprocating latch are both one-piece molded parts that can be assembled into said light fixture without the use of separate fasteners.

6. A light fixture as set forth in claim 5 wherein said reciprocating latch includes a resilient stop that permits said reciprocating latch to be snap-fittingly installed into said first opening, said resilient stop being adapted to engage the backside of said material forming said first opening to retain said reciprocating latch to said light fixture after installation of said reciprocating latch.

7. A light fixture as set forth in claim 1 wherein said fixed latch and said reciprocating latch are both one-piece molded parts that can be assembled into said light fixture without the use of separate fasteners.

8. A light fixture as set forth in claim 1 wherein said front portion of said light fixture includes material defining a first opening having opposing sides, and said reciprocating latch includes a body connected to said first leg, said body including opposing protrusions for slideably engaging said opposing sides of said first opening, said protrusions and said opening sides cooperating to guide the movement of said reciprocating latch as same is moved.

9. A light fixture as set forth in claim 8 wherein said body includes a depression for receiving an operator's fingertip to facilitate moving said reciprocating latch to said retracted position for releasing and removing an installed one of said light fixtures.

10. A light fixture as set forth in claim 8 wherein said reciprocating latch includes a resilient stop connected to said body in a location opposite said first leg, said stop having a free end extending at an angle upwardly and reversely toward said first leg from said body, said resilient stop being movable to a depressed first position adjacent said body for installing said reciprocating latch in said first opening, but being resiliently biased to a second position away from said body for abuttingly retaining said reciprocating latch in said first opening by abuttingly engaging on the backside of the material defining said first opening after said reciprocating latch is inserted into said first opening.

11. A light fixture as set forth in claim 1, including: a flexible cord for supplying electrical power to said light fixture; and wherein said fixed latch includes a clip for detachably retaining said cord therein to position the same neatly at the rear of said light fixture.

12. A light fixture as set forth in claim 1 including latch receiving openings in said front portion and said rear portion of said light fixture, said fixed latch and said reciprocating latch being adapted to snap-fit into said latch receiving openings.

13. In a light fixture for raised furniture units and the like, the improvement of a detachable mounting arrangement therefor, comprising:

a front support ledge adapted for positioning in a lower position of a raised furniture unit, and facing generally rearwardly;

a rear support ledge adapted for positioning in the lower portion of the raised furniture unit, and facing generally forwardly, opposite said front support ledge;

a fixed latch connected with said light fixture, and protruding outwardly from a rear portion thereof; said fixed latch being shaped for abutting support on said rear support ledge;

a reciprocating latch connected with said light fixture, and selectively protruding outwardly from a front portion thereof for shifting between a fully extended position, and a fully retracted position; said reciprocating latch having a one-piece, resilient construction with first and second legs oriented in a generally dihedral relationship, wherein a forward portion of said first leg is shaped for abutting support on said front support ledge when said reciprocating latch is in the fully extended position, an upper portion of said second leg is connected with said light fixture, and configured to resiliently urge said reciprocating latch toward the fully extend position, and a rearward portion of said first leg includes a stop which engages an associated portion of said light fixture, and positively prevents said reciprocating latch from moving beyond its fully extended position against the spring force in said second leg, whereby said light fixture is mounted in the raised furniture unit by positioning said fixed latch on said rear support ledge, pivoting the front portion of said light fixture upwardly into the lower portion of the raised furniture unit while said reciprocating latch is shifted inwardly against the spring force of the second leg toward the fully retracted position, and releasing said reciprocating latch, such that the spring force in said second leg resiliently shifts said reciprocating latch to the fully extended position to engage said first leg with said front support ledge, and thereby securely mount said light fixture in the raised furniture unit, without requiring any tools.

14. A light fixture as set forth in claim 13, including: a flexible cord for supplying electrical power to said light fixture; and wherein said fixed latch includes a clip for detachably retaining said cord therein to position the same neatly at the rear of said light fixture.

15. A light fixture as set forth in claim 13 wherein said front portion of said light fixture includes material defining a first opening, and said reciprocating latch is adapted to slideably engage said material and move between said extended position and said retracted position.

16. A light fixture as set forth in claim 15 wherein said reciprocating latch includes a body connected to said first leg, said body including opposing protrusions for engaging opposing sides of said first opening, said protrusions and said opening sides cooperating to guide the movement of said reciprocating latch as same is moved.

17. In a light fixture for raised furniture units and the like, the light fixture having a flexible power cord for supplying electrical power to the light fixture, the improvement of a detachable mounting arrangement therefor, comprising:

a front support ledge adapted for positioning in a lower portion of a raised furniture unit, and facing generally rearwardly;

a rear support ledge adapted for positioning in the lower portion of the raised furniture unit, and facing generally forwardly, opposite said front support ledge;

a one-piece fixed latch connected with said light fixture, and protruding outwardly from a rear portion thereof; said fixed latch having an "L" shape including a first arm shaped for abutting support on said rear support ledge and a second arm, said second arm including a protrusion adapted to snap-fit onto said light fixture and further including a clip for retaining the power cord therein;

a reciprocating latch connected with said light fixture, and selectively protruding outwardly from a front portion thereof for shifting between a fully extended position, and a fully retracted position; said reciprocating latch having a first leg with a portion thereof shaped for abutting support on said front support ledge when said reciprocating latch is in the fully extended position, a second leg with a portion thereof ramp-shaped and oriented at a generally acute angle to said first leg portion to slidingly abut a rearward edge of said front support ledge, and means for resiliently biasing said reciprocating latch toward the fully extended position;

said light fixture including material forming a latch-receiving aperture and said reciprocating latch further including a body for slideably engaging said latch-receiving aperture, said body including a retaining stop extending from said body to reversely engage the material forming said latch-receiving aperture to retain said reciprocating latch therein, whereby said fixed latch and reciprocating latch can be snap-fittingly installed on said light fixture without the need for separate fasteners, and also whereby said light fixture is mounted in the raised furniture unit by positioning said fixed latch on said rear support ledge, pivoting the front portion of said light fixture upwardly into the lower portion of the raised furniture unit, such that the ramp-shaped portion of said latch second leg slidingly abuts the rearward edge of said front support ledge, and thereby shifts said reciprocating latch toward the fully retracted position until said first leg portion passes over the rearward edge of said front support ledge, at which time said biasing means resiliently shifts said reciprocating latch to the fully extended position to engage said first leg portion with said front support ledge, and thereby securely mount said said light fixture in the raised furniture unit, without requiring any tools.

18. A detachable mounting arrangement for office furniture and the like, comprising:

a base furniture member including a recess having a ledge therein and a remote retaining receiving means located in the recess remote from said ledge;

a detachable furniture member adapted to be mounted in said recess, said detachable furniture member having a first side wall defining at least a part of the perimeter of said detachable member and having a second side wall oriented generally perpendicular to and joined to said first side wall, said first and second side walls being made of a sheet material and having a single continuous and irregularly shaped aperture formed therein which extends onto both of said side walls, said aperture being defined by upper opposing marginal edges on said first side wall and lower opposing marginal edges on said second side wall, said aperture including a pair of opposing cutouts in said second side wall;

a reciprocating latch having a rectangular body adapted to slide into said aperture through said first wall in a direction parallel to said second wall, said body including sides slideably abutting said upper opposing marginal edges of said shaped aperture and slideably engaging said lower opposing marginal edges of said shaped aperture so as to be slideable between an extended position and a retracted position, said body including opposing protrusions adapted to slip through said opposing cutouts and slidingly rest on said lower opposing marginal edges, said body including flanges spaced from said protrusions and adapted to cooperate with said protrusions to slidingly capture said lower opposing marginal edges relative to said body, said reciprocating latch including biasing means for biasing said body toward the extended position, said reciprocating latch further including a first leg with a free end extending generally perpendicular to said first side wall and adapted to abuttingly engaging said ledge on said base member, and including a second leg connected to the free end of said first leg and extending at an angle generally toward said first wall and away from said second wall, said body including a resilient stop adapted to ramp into a compressed condition as said reciprocating latch is being inserted into said aperture and then spring outwardly to engage the backside of said first wall to retain said reciprocating latch therein as said reciprocating latch reaches said extended position, at which position said reciprocating latch is fully installed in said shaped aperture; and said detachable furniture member also including remote retaining means for engaging said remote retaining receiving means, said remote retaining means cooperating with said reciprocating latch to retain said detachable furniture member in said recess, said remote retaining means being located remote from said reciprocating latch on said detachable member, whereby said detachable furniture member is mounted in the recess of the base member by positioning said remote retaining means in said recess and pivoting said detachable furniture member upwardly into said recess, such that the second leg of said reciprocating latch slidingly abuts the ledge in said recess, and thereby shifts said reciprocating latch toward the fully retracted position until said first leg passes over the ledge, at which time said biasing means shifts said reciprocating latch to the fully extended position to engage said first leg with said ledge, and thereby securely mount said detachable furniture member in the recess of said base furniture member, without requiring any tools and without requiring that any latch be manually manipulated during installation of said detachable furniture member.

* * * * *